US007172498B2

(12) United States Patent
Bernard et al.

(10) Patent No.: US 7,172,498 B2
(45) Date of Patent: Feb. 6, 2007

(54) DRILL SHARPENER

(75) Inventors: David A. Bernard, Ashland, OR (US); William C. Christian, Ashland, OR (US); Scott Harris, Eagle Point, OR (US); Keith Mosttler, White City, OR (US)

(73) Assignee: Professional Tool Manufacturing, LLC, Ashland, OR (US)

( * ) Notice: Subject to any disclaimer, the term of this patent is extended or adjusted under 35 U.S.C. 154(b) by 0 days.

(21) Appl. No.: 10/529,426

(22) PCT Filed: Sep. 26, 2003

(86) PCT No.: PCT/US03/30033

§ 371 (c)(1),
(2), (4) Date: Mar. 25, 2005

(87) PCT Pub. No.: WO2004/028742

PCT Pub. Date: Apr. 8, 2004

(65) Prior Publication Data

US 2006/0003676 A1 Jan. 5, 2006

Related U.S. Application Data

(60) Provisional application No. 60/413,772, filed on Sep. 27, 2002.

(51) Int. Cl.

| | |
|---|---|
| ***B24B 7/00*** | (2006.01) |
| ***B24B 9/00*** | (2006.01) |
| ***B24B 19/00*** | (2006.01) |
| ***B24B 55/04*** | (2006.01) |

(52) U.S. Cl. ..... 451/231; 451/233; 451/375; 451/453

(58) Field of Classification Search ..... 451/231, 451/233, 375, 451, 453, 456
See application file for complete search history.

(56) References Cited

U.S. PATENT DOCUMENTS

| | | | |
|---|---|---|---|
| 2,109,308 | A | 2/1938 | Adams |
| 2,377,271 | A | 5/1945 | Schumann |
| 2,426,478 | A | 8/1947 | Whipple |
| 2,881,066 | A | 4/1959 | Sproull et al. |
| 3,126,679 | A | 3/1964 | Abadjieff |
| 4,093,247 | A | 6/1978 | Bernard et al. |

(Continued)

FOREIGN PATENT DOCUMENTS

| | | | |
|---|---|---|---|
| DE | 3342914 | A1 | 6/1985 |

*Primary Examiner*—M. Rachuba
(74) *Attorney, Agent, or Firm*—Fellers, Snider, et al.

(57) ABSTRACT

A drill sharpener is provided which has a point-splitting port which simplifies the procedure for producing a split point on a drill bit undergoing sharpening. The point-splitting port is positioned relative to a grinding wheel assembly such that, when the drill held by a chuck is advanced toward the grinding wheel, a flute of the drill at the drill tip is brought into contact with the grinding wheel. The port has alignment stops therein which mate with flats provided on the barrel of the chuck to ensure proper alignment of the chuck and drill relative to the grinding wheel. The stops also limit the extent of inward travel of the chuck and drill to a predetermined distance. A debris or grit collection tube is also provided to be inserted into an unused port of the drill sharpener, to contain and confine any debris or grit attempting to exit the sharpener through the unused port.

9 Claims, 4 Drawing Sheets

U.S. PATENT DOCUMENTS 4,471,581 A 9/1984 Bernard et al.
4,485,596 A 12/1984 Bernard et al.
4,551,948 A 11/1985 Kindig et al.
4,916,866 A 4/1990 Bernard et al.
5,031,925 A 7/1991 Tatsu et al.
5,062,322 A 11/1991 Sinko
5,097,634 A 3/1992 Hulme
5,179,809 A 1/1993 Schroeder
5,400,546 A 3/1995 Christian et al.
5,549,509 A 8/1996 Hirst et al.
5,735,732 A 4/1998 Bernard
5,788,559 A 8/1998 Jungnitsch
6,110,018 A 8/2000 Hepworth

DRILL SHARPENER

CROSS-REFERENCE TO RELATED APPLICATION

This application relates to, and claims the benefit of the filing date, of U.S. Provisional Application Ser. No. 60/413,772, filed Sep. 27, 2002.

BACKGROUND OF THE INVENTION

1. Field of the Invention

The present invention relates to a power drill sharpener, and more specifically to a power drill sharpener having a push-in point splitting port and a tube designed to collect debris generated in a drill sharpening process.

2. Description of Related Art

Drill sharpeners are known for use in industrial environments. In high-volume manufacturing operations, high-quality, precision drill sharpeners, even though quite expensive to purchase, are recognized as being cost effective devices. The use of a drill sharpener will prolong the effective life of a drill, thereby reducing costs by reducing consumption of the drill bits, and using sharp drill bits improves production quality and yield of products requiring bores or holes to be drilled therein during the production process. Further details relating to the economics of employing a high quality drill sharpener can be found in U.S. Pat. No. 5,400,546, issued to Christian and Bernard.

The benefits of high quality drill sharpeners have also been appreciated by smaller-volume operations, such as machine shops, other small businesses, and by individual craftsmen and hobbyists who use drills frequently. The high cost of precision drill sharpeners historically rendered them less cost effective, due to the lower volume of drilling being performed. In addition, the industrial drill sharpeners are quite large, having a grinding wheel on the order of six (6) inches or more in diameter, with the overall unit having a footprint (area of a surface taken up by the unit resting thereon) of several square feet. Many small businesses, and certainly hobbyists, would not normally have adequate space to set up such a unit, even if it were somewhat cost effective.

Recently, advancements have been made, by one or more of the inventors named herein, in the design of drill sharpeners, with the specific purpose of reducing the size and manufacturing cost of the unit, while maintaining the precision at an acceptable level, and without sacrificing features related to setup and alignment which make the sharpeners easy to use and reliable. Those advancements have resulted in making high quality drill sharpeners available to a larger market that includes the lower volume operations, small businesses, craftsman and hobbyists. The less expensive, but still precise, sharpeners are also even more cost effective, which further broadens the potential market. U.S. Pat. No. 5,735,732, which is hereby expressly incorporated by reference herein, discloses a drill sharpener configuration which incorporates the advancements which yield a compact, less expensive, precise, and reliable drill sharpener suited for lower volume work.

SUMMARY OF THE INVENTION

The present invention relates to further enhancements or improvements in a compact drill sharpener which is generally of the type disclosed in U.S. Pat. No. 5,735,732 ("the '732 patent"). More specifically, the present invention is directed to a variant on the point-splitting port and method of splitting a point disclosed in the aforementioned patent. The point-splitting port of the present invention is believed to be simpler to use than that disclosed in the patent.

A further enhancement to the drill sharpener disclosed in the '732 patent is provided in the present invention. The drill sharpener in a preferred embodiment has two ports into which a drill chuck holding a drill to be sharpened is inserted. One port is used to present the drill to the grinding wheel so that the faces and cutting edges of the drill can be ground in the sharpening process. This will be referred to as a sharpening port. A second port is the point-splitting port mentioned above. This port is used to split the point of the drill (i.e., remove the web joining the inner portions of the two flutes) after the cutting areas have been sharpened.

A considerable amount of debris is generated when the drill is being sharpened, particularly in the sharpening of the cutting surfaces. The debris is primarily particles of the drill material that have been ground off, but also will include particles of the abrasive dislodged from the grinding wheel, and possibly foreign materials that are present on the surfaces being sharpened. The drill sharpener is provided with a debris collection chamber, which collects debris thrown from the grinding wheel. However, in a preferred embodiment of this invention, the point-splitting port is located to the side of the unit, at approximately the same level as the grinding wheel and the debris collection chamber. As such, when the sharpening port is in use, the point-splitting port presents an opening near the grinding wheel where debris can exit the unit.

A debris collection tube has been developed which can be inserted into the point-splitting port to substantially prevent debris from exiting the unit. The tube is provided with a cap which will serve as a physical barrier to the debris, and is vented to allow airflow therethrough. The cap is also removable if it is desired to attach the collection tube to a vacuum unit.

BRIEF DESCRIPTION OF THE DRAWINGS

The above and other features of the present invention and the attendant advantages will be better understood from the ensuing Detailed Description of the Preferred Embodiments, taken in conjunction with the drawings filed herewith, in which.

DETAILED DESCRIPTION OF THE PREFERRED EMBODIMENTS

The drill sharpener according to a preferred embodiment of the present invention includes a housing 10, which encloses a motor 12 and a grinding wheel assembly 14. The motor is preferably a high-speed motor capable of operating at speeds on the order of about 15,000–20,000 RPM. The grinding wheel assembly is preferably substantially identical to that disclosed in the '732 patent, and the diameter of the diamond-plated ring that forms the grinding surface is preferably on the order of ½ to 2½ inches. Even more preferably, the diameter of the ring is about 1 to 1½ inches. Further, a diameter of 1¼ inches is preferred.

Figure 1:
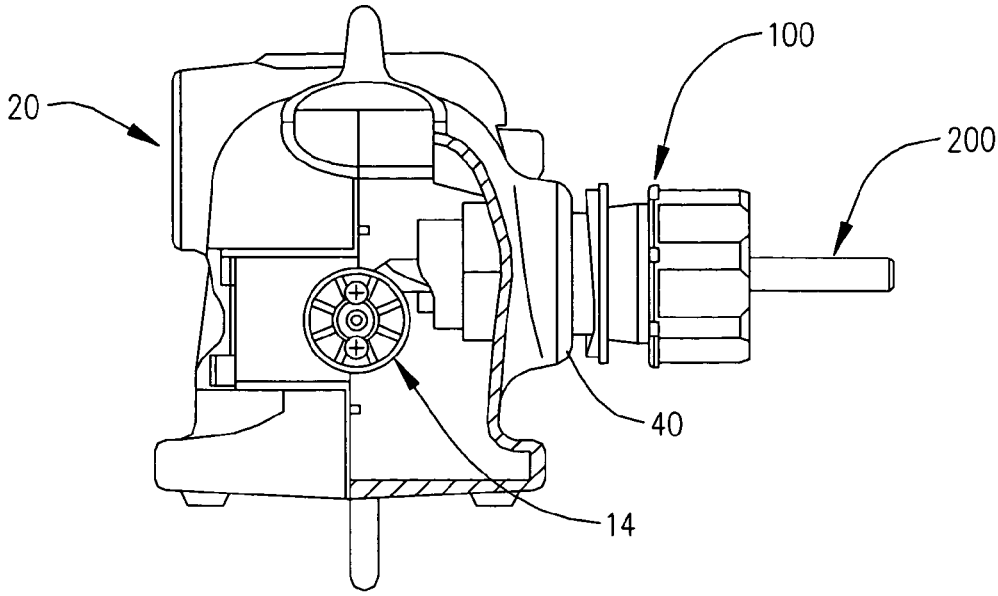
FIG. 1 is a front elevation, partially cutaway, view of the drill sharpener according to a preferred embodiment of the present invention.
Figure 2:
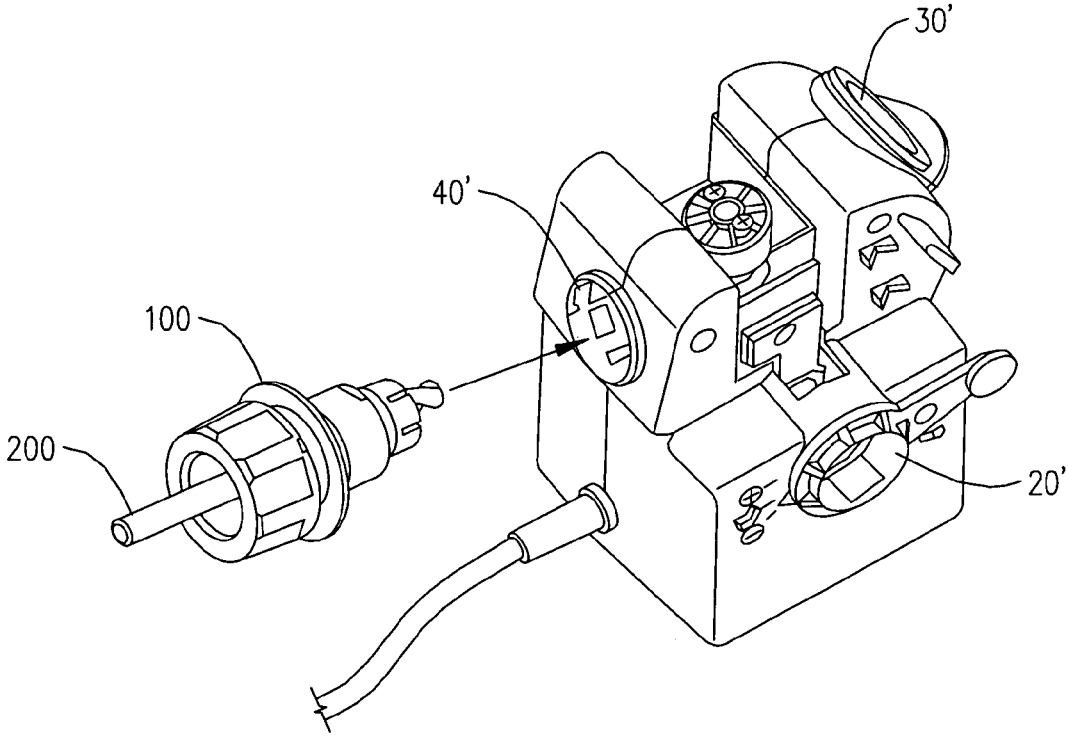
FIG. 2 is a perspective view of the drill sharpener and chuck according to an alternative preferred embodiment.
Figure 3:
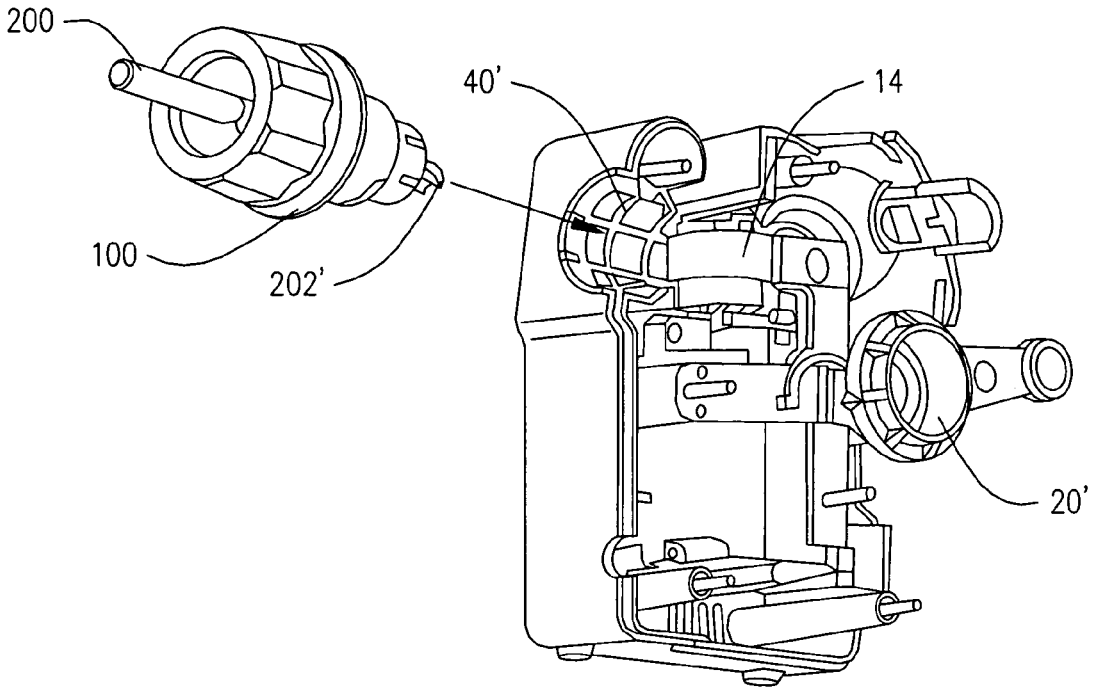
FIG. 3 is a further perspective view of a drill sharpener and chuck, with a portion of the housing removed, according to an alternative preferred embodiment of the present invention.
Figure 4:
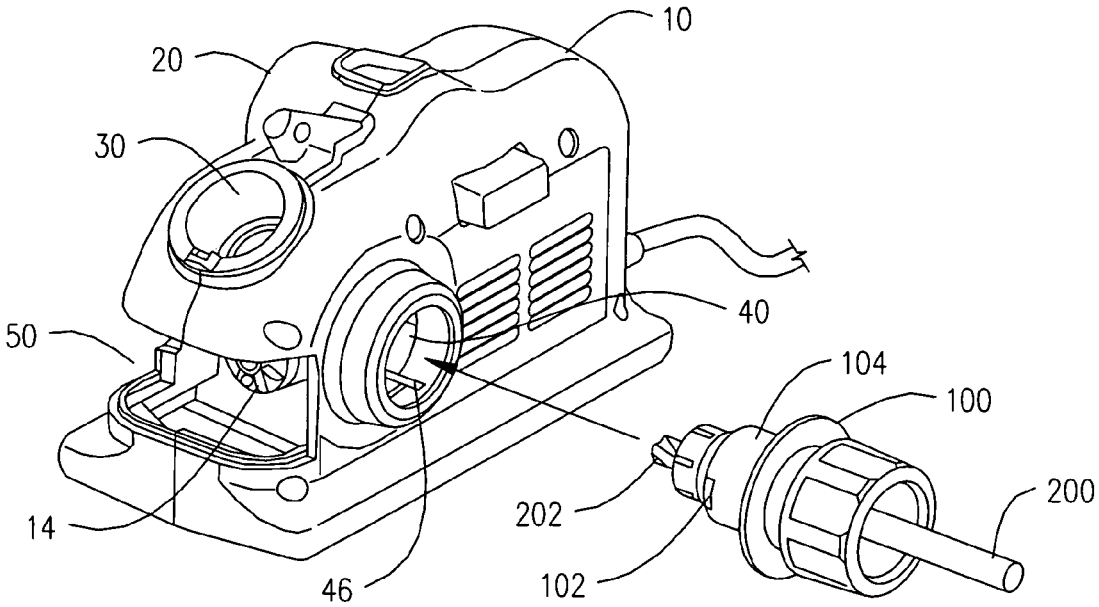
FIG. 4 is a perspective view of the drill sharpener according to the FIG. 1 embodiment.
Figure 5:
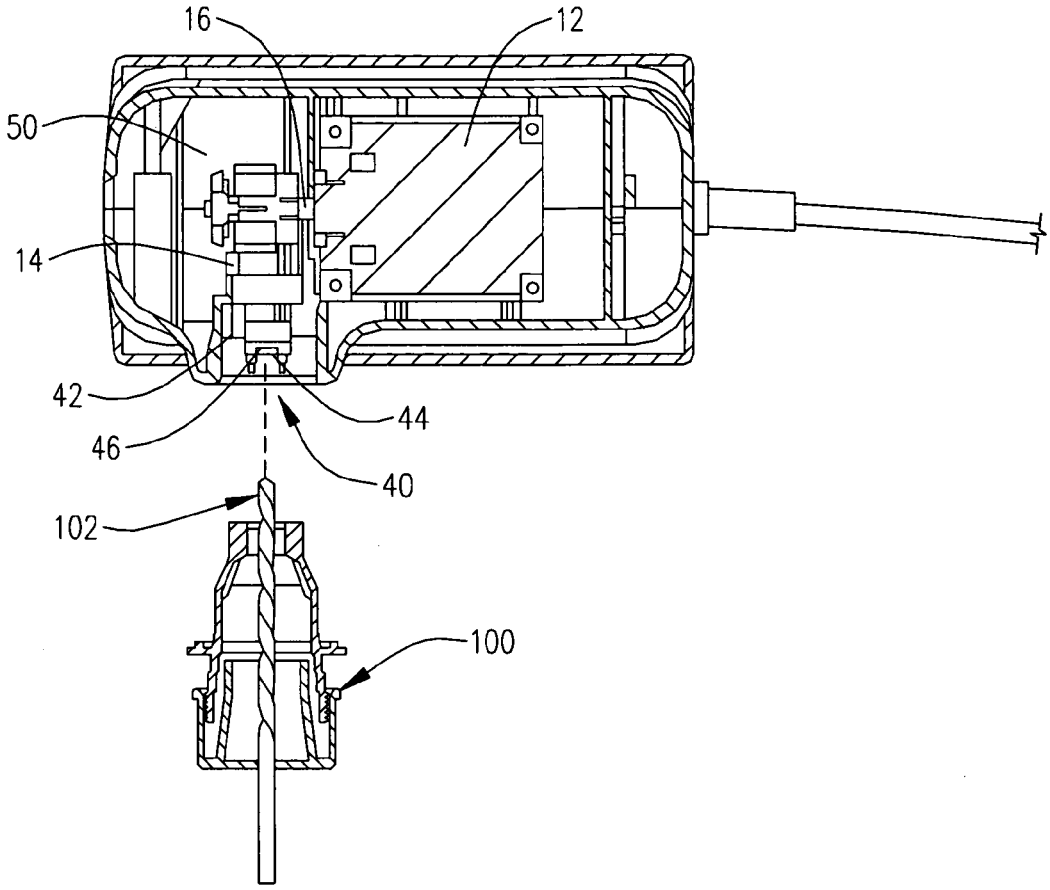
FIG. 5 is a top plan view, partially cutaway and partially in cross-section, of the drill sharpener according to the FIG. 1 embodiment.

The grinding wheel assembly 14 is operably coupled to the shaft 16 of the motor, preferably in a direct drive engagement. It can be seen in the several drawing figures that the unit may take on a vertical orientation, with the motor shaft extending vertically upwardly with the grinding wheel assembly positioned above, in the manner disclosed in the '732 patent. Alternatively, the sharpener may be in a horizontal orientation, as seen in FIGS. 1, 4 and 5, in which the axis of the motor shaft extends along a substantially horizontal axis. The grinding wheel assembly is likewise oriented 90° from the other embodiment, and will rotate in a vertical "plane".

Each of these alternative designs will have a sharpening port and a point-splitting port. In addition, a drill bit alignment port 20, 20' is preferably provided so that the drill bit 200 can be properly positioned in a holder, namely a chuck 100, of the type described in the '732 patent. The process for initially setting up the drill bit 200 to be sharpened in the chuck is also as described in the '732 patent.

In sharpening a drill using this drill sharpening unit, the chuck 100 holding the drill 200 in proper alignment therein is inserted into the sharpening port 30, 30', and sharpened in the manner disclosed in the '732 patent. Thereafter, if it is desired to provide the drill with a split point (either if the drill was initially a split point drill, or if it is desired to convert the drill being sharpened to a split point drill), the chuck and drill are then positioned to be inserted into the point-splitting port 40, 40'. In the '732 patent, the point splitting port was designed to receive the chuck fully therein without the drill contacting the grinding wheel. That port was designed to permit the user to rock the chuck 100 and drill 200 back and forth, such that the proper surface of the drill point would be brought into contact with the grinding wheel to remove material from the web of the drill, to thereby split the point.

The point-splitting port of the present invention allows for much simpler operation. The port 40, 40' is oriented relative to the ring of the grinding wheel assembly 14 such that, when the chuck 100 and drill 200 are inserted into the port in proper alignment, the inner portion 202 of the tip of the flute will contact the grinding ring and a predetermined amount of material will be ground off as the chuck and drill are further advanced into the port. The port has stops 42 positioned therein to limit the depth to which the chuck can be inserted. Those stops are configured and positioned to engage and to cooperate with two opposing flats 102 presented on a forward portion of the chuck 100.

The stops 42 present complementary engagement surfaces for the flats 102 on the chuck, and initially, upon insertion of the chuck into the port, serve to orient the chuck in the proper position to present the necessary surface of the drill to the grinding wheel assembly 14. In other words, when the user begins to insert the chuck into the port, the stops 42 will prevent insertion at any orientation in which the flats 102 are not matched up with the stops, by physically interfering with the otherwise cylindrical surface of the chuck. The user must rotate the chuck until the flats and stops come into register. The chuck may then be pushed further into the port, to push the drill into contact with the grinding wheel.

Upon further insertion of the chuck, the stops will engage the cylindrical barrel 104 of the chuck at the point where the flats terminate. The stops thus will prevent further insertion of the chuck, signifying to the user that the grinding operation is complete. The point splitting operation requires that the inner portion of both flutes of the drill 200 be ground, and thus, after completing the first insertion, the user retracts the chuck, rotates it 180°, and reinserts the chuck. The stops again permit the chuck to be inserted only when the flats 102 on the chuck are in register with the stops 42. The user then pushes the chuck forward into the port to grind the other flute to produce the completed split point. The port thus allows the point to be split using a simple push-in motion.

The specific construction of the port, and the positioning thereof relative to the grinding surface are significant factors in providing the ability to split the point using just a pushing motion. As seen especially in FIG. 7, the port is a generally circular and cylindrical opening in the housing with substantially cylindrical walls extending inwardly toward the grinding wheel. The stops 42 preferably comprise two diametrically opposed raised sections which protrude radially inwardly from the cylindrical walls. The stops, as discussed previously, present two parallel surfaces past which the flats on the chuck may slide. The stops 42 are positioned, and the chuck flats 102 are sized, so as to permit the chuck to be inserted into the port to a predetermined distance, at which distance, the drill carried by the chuck will have engaged the grinding wheel along a desired portion thereof, on the order of ⅛ of an inch. The grinding of the inner surface of the two flutes to such a distance will produce a split point. It can be seen in FIG. 7 that the flutes will be directed into contact with an edge 26 of the grinding wheel 24, which will control the amount of material removed from the drill flutes.

The point-splitting port has a preload element 44 which facilitates the precise insertion of the chuck into the port at the same position and angle of orientation each time. The inwardly protruding cylindrical wall in the port has an open section along a portion of the wall. A tab 46 is provided to extend into this open section, with the tongue of the tab being positioned substantially at the same circumferential position as where the wall would otherwise be located. At the free end of the tongue, the tab has a radially inwardly extending flange 48. This flange protrudes inwardly for a short distance into the opening defined by the cylindrical wall of the port 40. The flange engages the outer surface of the chuck barrel 104 when the chuck barrel is inserted, to position or center the chuck barrel in the port. The tongue has some degree of flexibility to prevent any binding of the chuck within the port.

The use of this preload element 44 enables the port opening to be sized slightly larger overall than the size of the chuck barrel being introduced therein. Without the preload element, the size of the opening would have to be nearly identical to the outer diameter of the chuck barrel, in order to have the chuck enter at the same position each time. This would, however, greatly increase the cost of manufacture, in that the tolerances for the size of the opening would have to be much smaller. In addition, even using very tight tolerances, the chances of the chuck binding up in the port would be substantially higher. The preload element accomplishes the same result by contacting only a small section of the chuck barrel being inserted, and using that contact to properly center the chuck within the port.

Figure 7:
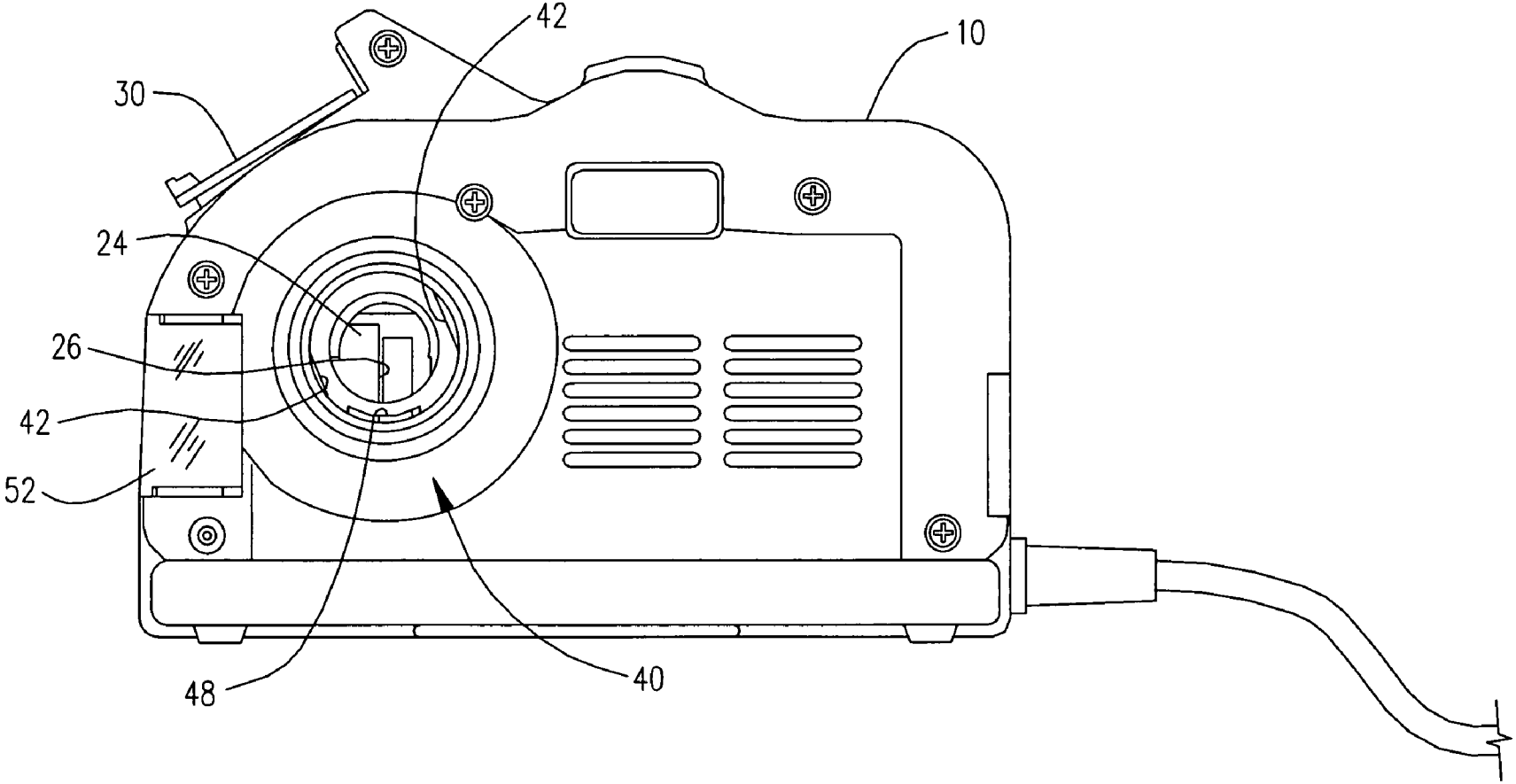
FIG. 7 is a side elevation view of the drill sharpener in accordance with the FIG. 1 embodiment.

As can be seen in the unit illustrated in FIGS. 4, 5, and 7, which has the so-called horizontal orientation, the point-splitting port 40 is located at the side of the unit. The debris-catching chamber 50 is at the front of the unit, and will have a removable plastic cover 52, which is preferably transparent or translucent, extending across and around the exposed area shown in the drawing figure. It will be recognized that the point-splitting port 40 constitutes a fairly large opening through which debris can escape while the sharpening port 30 is in use.

Figure 6:
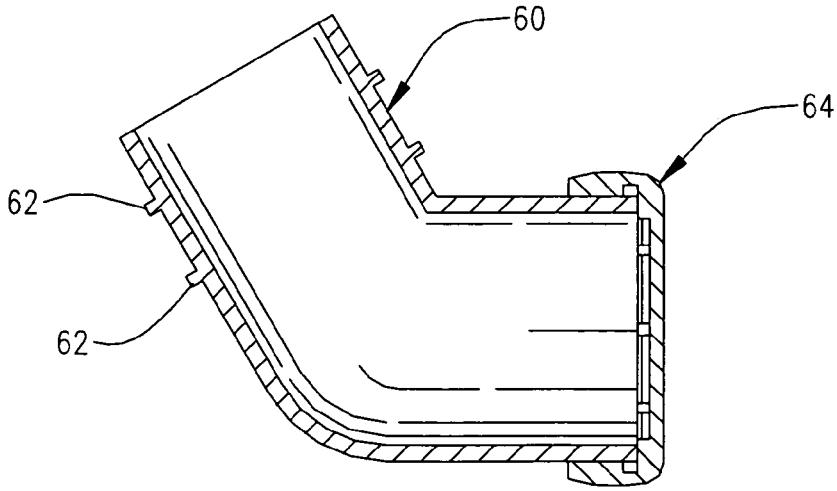
FIG. 6 is a cross-sectional view of a grit collection tube according to a preferred embodiment of the present invention.

In order to substantially eliminate or minimize the amount of debris exiting the unit while in operation, a debris collection tube 60, preferably of the configuration shown in FIG. 6, may be provided. The debris collection tube is shown in cross section, but it will readily be recognized that the tube will be cylindrical and of a size that will enable the tube to be inserted into the point-splitting port (as well as the sharpening port, which is of essentially the same diameter). The tube may preferably have one or more external ribs 62 which aid in seating the tube inside the port, and provide some measure of sealing the tube against the cylindrical wall of the port 40.

As shown in this preferred embodiment, the tube is formed in the manner of an elbow, and the portion protruding from the port can preferably be canted downwardly to collect particles with the aid of gravity as the debris flows into and through the tube. A cap 64 is provided at the outward extent of the tube, and spacing between the cap and the tube is provided to allow for the venting of air while the cap operates to trap the grit and other debris inside the tube.

The cap is preferably made to be removable, to allow it to be removed and to allow a vacuum hose, such as a Shop-Vac hose or tube, to be connected thereto, to draw out the debris from the area of the grinding wheel. In a preferred embodiment, the outer end of the tube will be sized and configured to mate with a 1¼ inch diameter Shop-Vac tube.

The foregoing description and appended drawings represent one or more preferred embodiments of the invention. Various modifications and enhancements may become apparent to those of ordinary skill in the art, and such modifications and enhancements are within the spirit and scope of the invention. The scope of the invention is defined by the appended claims.

The invention claimed is:

1. A drill sharpener comprising a housing which encloses a rotatable grinding wheel assembly, the housing having a point-splitting port to facilitate a point-splitting operation upon a multi-flute drill bit to remove material between said flutes, the port comprising a guide feature that maintains a longitudinal length of the bit along a predetermined axial line and at a predetermined angular orientation with respect to said line as said material is removed by the grinding wheel assembly, and wherein the point-splitting operation is carried out by inserting the bit into the port and using the guide feature to maintain the bit in a first orientation while removing a first portion of said material from the bit, removing the bit from the port, and reinserting the bit into the port and using the guide feature to maintain the bit in a second orientation that is 180 degrees opposite the first orientation with respect to the axial line while removing a second portion of said material from the bit, wherein said point-splitting port has an opening slightly larger than a barrel of a chuck to be inserted therein, the chuck adapted to hold said bit during said point-splitting operation, wherein the guide feature cooperates with a surface of the chuck to maintain the bit along said predetermined axial line and a said predetermined angular orientation, and wherein the port further comprises a generally cylindrical wall of the housing and wherein the guide feature comprises a resilient portion of said generally cylindrical wall and a flange protruding radially inwardly from said resilient portion of said wall.

2. A drill sharpener as recited in claim 1, wherein said resilient portion of said wall comprises a tongue element formed in said wall and attached to said wall at one end thereof.

3. A drill sharpener as recited in claim 1, wherein the port further comprises a stop feature that limits further advancement of the bit along the predetermined axial line to limit the amount of said material removed from said bit.

4. A drill sharpener as recited in claim 1, further comprising a chuck adapted to support the bit during insertion of the bit into the port, the chuck comprising an outer surface with a recess extending therein, the recess configured to engage the guide feature of the port.

5. A drill sharpener comprising a housing which encloses a grinding wheel assembly and a chuck adapted to securely retain a multi-flute drill bit, the housing comprising a sharpening port adapted to receive the chuck to present said drill bit to the grinding wheel assembly to sharpen said flutes, the housing further comprising a point-splitting port adapted to receive the chuck to present said drill bit to the grinding wheel assembly to remove material between said flutes, wherein the point-splitting port comprises a guide feature that maintains a longitudinal length of the bit along a predetermined axial line and at a constant angular orientation with respect to said line prior to and during the point-splitting operation, wherein the point-splitting port further comprises a generally cylindrical wall of the housing and wherein the guide feature comprises a resilient portion of said generally cylindrical wall and a flange protruding radially inwardly from said resilient portion of said wall.

6. A drill sharpener as recited in claim 5, wherein the point-splitting port has an opening slightly larger than a barrel of the chuck, and wherein the guide feature cooperates with a surface of the chuck to maintain the bit along said predetermined axial line and at said predetermined angular orientation during the point-splitting operation.

7. A drill sharpener as recited in claim 5, wherein said resilient portion comprises a tongue element formed in said wall and attached to said wall at one end thereof.

8. A drill sharpener as recited in claim 5, wherein the point-splitting port further comprises a stop feature that limits further advancement of the bit along the predetermined axial line to limit the amount of said material removed from said bit.

9. A drill sharpener as recited in claim 5, wherein the housing further comprises a sharpening port adapted to receive the chuck to present said drill bit to the grinding wheel assembly to sharpen said flutes, wherein the drill sharpener further comprises a debris collector to collect debris from the grinding wheel assembly, and wherein the collector is adapted to be removeably coupled to either one of said ports while the chuck is inserted into the remaining one of said ports.

* * * * *